United States Patent [19]

Shibata et al.

[11] Patent Number: 4,907,530

[45] Date of Patent: Mar. 13, 1990

[54] APPARATUS FOR APPLYING A LIQUID TO A SUPPORT

[75] Inventors: Norio Shibata; Hideo Takeda; Tsunehiko Sato, all of Kanagawa, Japan

[73] Assignee: Fuji Photo Film Co., Ltd., Kanagawa, Japan

[21] Appl. No.: 287,621

[22] Filed: Dec. 20, 1988

Related U.S. Application Data

[63] Continuation of Ser. No. 73,660, Jul. 15, 1987, abandoned.

[30] Foreign Application Priority Data

Jul. 15, 1986 [JP] Japan ..... 61-164719

[51] Int. Cl.[4] ..... B05C 1/04; B05C 1/16

[52] U.S. Cl. ..... 118/410; 118/419

[58] Field of Search ..... 118/410, 415, 407, 411, 118/412, 413, 419

[56] References Cited

U.S. PATENT DOCUMENTS

| | | | |
|---|---|---|---|
| 1,494,315 | 5/1924 | Ostenberg | 118/415 |
| 2,464,771 | 3/1949 | Van Guelpen | 118/410 X |
| 2,774,327 | 12/1956 | Saint-Hilaire | 118/33 |
| 2,891,506 | 6/1959 | Saint-Hilaire | 118/415 |
| 2,942,293 | 6/1960 | Wahl | 118/410 X |
| 3,526,535 | 9/1970 | Plumat | 118/407 |
| 4,480,583 | 11/1984 | Tanaka et al. | 118/410 |

*Primary Examiner*—Willard Hoag

*Attorney, Agent, or Firm*—Sughrue, Mion, Zinn, Macpeak & Seas

[57] ABSTRACT

An extrusion-type fluid applicator having a front wall located in upstream from a rear wall relative to a moving support (substrate) on which the applicator coats a liquid through a slot between the two walls. The front wall is convexly curved toward the support. The rear wall is retreated away from the convex surface of the front wall in a direction opposite the support. The slot is tapered to decrease the width thereof toward the support.

7 Claims, 3 Drawing Sheets

APPARATUS FOR APPLYING A LIQUID TO A SUPPORT

This is a continuation of application Ser. No. 073,660, filed 7/15/87, now abandoned.

BACKGROUND OF THE INVENTION

1. Field of the Invention

The present invention relates to an apparatus for applying a coating composition to a support, and more particularly, it relates to an apparatus having an extruder for continuously extruding a coating composition onto a surface of a moving support, to thereby coat the support with a uniformly thick layer of the coating composition.

2. Background of the Invention

The concept of the term "support" used in this specification generally includes a flexible belt like material with a width of 0.3 to 3 m, a length of 45 to 10,000 m and a thickness of 5 to 200 μm. Such a support may be a film of resin such as polyethylene terephthalte, polyethylene-2,6-naphthalate, cellulose diacetate, cellulose triacetate, cellulose acetate propionate, polyvinyl chloride, polyvinylidene chloride, polycarbonate, polyimide, polyamide and the like. It may be paper, or coated or lamination paper of α-polyolefin having 2 to 10 carbon atoms, such as polyethylene, polypropylene, ethylen-butene copolymer and the like. It may also be a metal foil of such as aluminum, copper, tin and the like. The concept of the term "support" further includes belt-like material provided by applying previously processed layers onto surfaces of the aforementioned belt-like material as substrates.

In general, supports of the type as described above may be used for the step of applying a coating composition, such as a photographic light-sensitive coating composition, a magnetic coating composition, a surface-protecting coating composition, an antistatic coating composition, a lubricating coating composition or the like to the surface of the support according to the desired purpose. The coating composition applied to the support is dried and the support is cut to a necessary width and length to thereby attain manufactured articles. Typical examples of such manufactured articles are various kinds of photographic film, photographic paper, magnetic tape and the like.

Heretofore, in order to apply the coating composition very thinly and uniformly while moving the support at a relatively high speed, for example, at 50 to 100 m/min, extruders using a doctor blade have been studied and surveyed from various approaches. Typical examples of methods thus studied include a web pressure type extrusion method as schematically shown in FIG. 1, a parallel slit extrusion method as shown in FIG. 2, and the like.

The conventional extruder 10 as shown in FIG. 1 has been disclosed in U.S. Pat. No. 4,424,762. In FIG. 1, the extruder 10 has a top end portion formed by a doctor blade 11 and a front blade 12. The term "front blade" herein used means a blade disposed in opposition to the doctor blade. The blades 11 and 12 form an exit area where the coating composition is extruded from the slot onto a support W. The support W is pressed onto the protruding surfaces of the blades 11 and 12 by guiding means such as guide rollers and the like so as to be slightly curved along the surfaces of the blades 11 and 12. Then, the distance between the support W and the doctor blade 11 located at the back of the slot with respect to the direction of movement of the support W is changed corresponding to the change in supply quantity or extrusion quantity to the coating composition extruded from the slot, thereby applying the coating composition to the surface of the support.

However, there exists a problem that a change is caused in the distance between the support W and the doctor edge 11 by various factors which are dependent on the support W, for example, a change in the thickness of the support W, irregularity in Young's modulus of the support W, and the like. These changes result in irregularity in thickness of the film formed on the support W by applying the coating composition thereto. There exists a further problem that foreign, substances such as dust particles and the like which have been carried on the support W are often caught by the doctor blade 11, so that streak-like irregularity of film occurs along the direction of movement of the support.

The conventional extruder 20 as shown in FIG. 2 has been disclosed in U.S. patent application, Ser. No. 824,193, filed on August 12, 1977. The extruder 20 shown in FIG. 2 is different from that shown in FIG. 1 in that the extruder 20 has no doctor blade. The extruder 20 is free from the aforementioned problem of streak-like irregularity caused by catching foreign substances. Particularly, in the case where a high viscosity coating composition is applied at high speed, a large discharge rate is required at the coating composition discharge side of the slot so that the slot gap (l) must be small. Hence, pressure loss of the coating composition which passes through the slot becomes a problem. In other words, pressure at the coating composition discharge side is too low relative to the pressure before the coating composition enters into the slot gap. Accordingly, the coating composition must be supplied to the extruder with very high pressure, for example, 50 $kgf/cm^2$ (pressure differs according to the conditions of application). Accordingly, a high pressure metering pump must be provided. However, there exists a serious problem in that it is difficult to produce such a high pressure metering pump and such a pump is expensive even if it can be produced.

SUMMARY OF THE INVENTION

It is therefore an object to solve the aforementioned problems with the conventional apparatus.

More particularly, it is object of the present invention to provide an apparatus for applying a coating composition to a support which avoids a streak-like irregularity of coating composition film caused by catching foreign substances in the extruder and variations in thickness of the coating composition film caused by variations in thickness and Young's modulus of the support.

It is a further object to provide a coating apparatus in which pressure loss of the coating composition which passes through the slot can be minimized.

In order to attain the above objects of the present invention, the apparatus for applying a coating composition to a support comprises an extrusion type head including a front blade and a back blade located in upstream and downstream portions respectively with respect to the direction of movement of the support. The front and back blades are arranged to form a coating composition discharging slot. The slot is tapered so that the slot has a width which decreases as the coating composition in the slot approaches an exit of the slot. The front blade has a blade surface curved so as to expand toward the support. The back blade having a top end placed at a short distance from that of the front blade so that the top end of the back blade is separated by a distance from the support in direction opposite to the support.

BRIEF DESCRIPTION OF THE DRAWINGS

The above and other objects, features and advantages of the present invention will appear more fully from the following description in conjunction with the accompanying drawings, in which.

DETAILED DESCRIPTION OF THE PREFERRED EMBODIMENT

An embodiment of an apparatus according to the present invention will be now described in detail with reference to the accompanying drawings.

Figure 1:
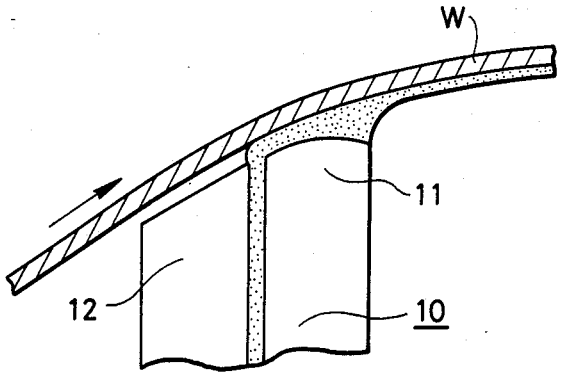
FIG. 1 PRIOR ART
FIGS. 1 and 2 are schematic sectional views of conventional extruders.
Figure 2:
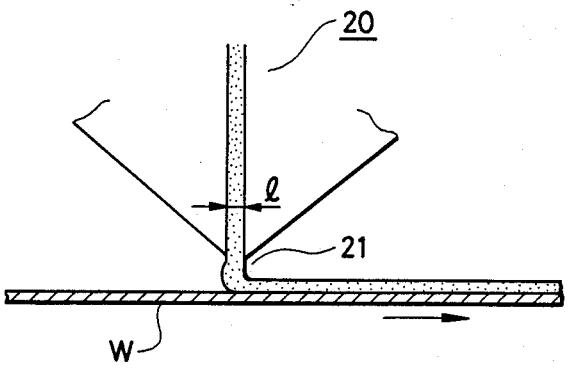
FIG. 2 PRIOR ART
Figure 3:
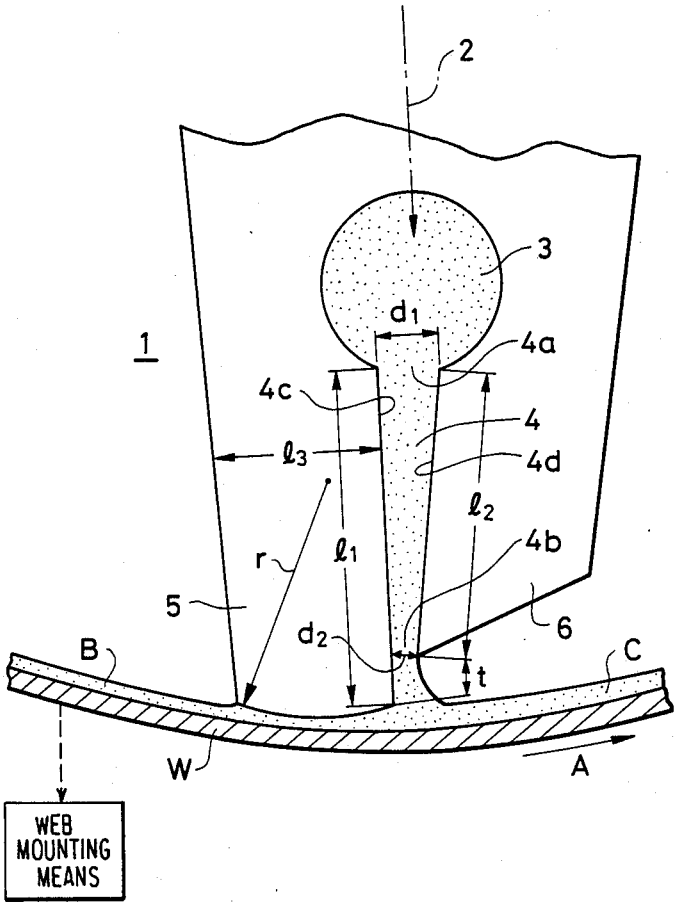
FIG. 3 is a sectional view of an extruder in an apparatus according to the present invention.
Figure 4:
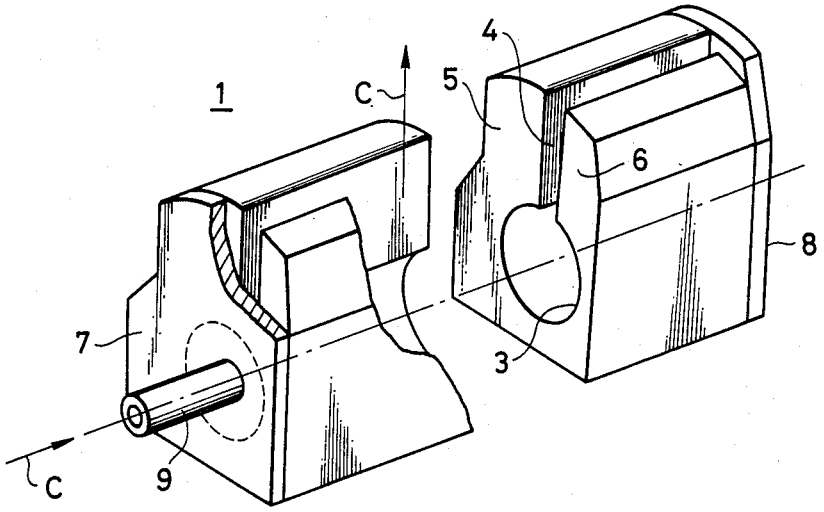
FIG. 4 is a partly cutaway perspective view of an embodiment of the extruder depicted in FIG. 3.

Referring to FIGS. 3 and 4, a non-doctor-blade type extruder 1 (hereinafter merely called "extruder 1") is substantially divided into a coating composition supply system 2, a pocket section 3, a slot section 4, a front blade section 5 and a back blade section 6. These will be respectively described in detail.

1. Fluid Supply System

The coating composition supply system 2 includes a metering pump mechanism (not shown) disposed at the outside of a body of the extruder 1 to make it possible to supply the coating composition C continuously and precisely. A piping member communicates the pump mechanism with the pocket section 3. The piping member pierces the body of the extruder 1 perpendicularly to the direction of movement of the support W.

2. Pocket Section

The pocket section 3 is a kind of coating composition reservoir which is substantially circularly shaped in sectional view as shown in FIG. 3 and extends with such a sectional form, perpendicularly to the direction of movement of the support W and parallel to the plane of the support W. The effective length of the pocket section 3 is generally selected to be equal to or slightly longer than the width of coating.

The internal diameter of the pocket section 3 is generally selected to be a value within a range of 10 to 50 mm. As shown in FIG. 4, openings at opposite ends of the pocket section 3 are respectively closed by shield plates 7 and 8 mounted on opposite ends of the extruder 1.

The coating composition supply system 2 is connected to a short pipe 9 extending from the shield plate 7 so that the pocket section 3 can be filled with the coating composition C through the pipe 9. As a result, the coating composition C can be uniformly pumped to the outside through the slot section 4 which will be described later.

3. Slot Section

As shown in cross section in FIG. 3, the width of the slot section 4 is tapered so that the width of the slot decreases as the coating composition moves from the pocket section 3 toward the support W, that is, from an entrance 4*a* to an exit 4*b*. Preferably, the entrance 4*a* has a width ($d_1$) of 0.1 to 5 mm and the exit 4*b* has a width of 0.02 to 0.3 mm. Such a slot 4 provides a relatively narrow flow path which pierces the body of the extruder 1 and extends perpendicularly to the direction of movement of the support W in the same manner as described above for the pocket section 3. The widthwise length of the slot section 4 taken perpendicularly to the direction of movement of the support W is substantially equal to the width of coating.

The length of the flow path of the slot section 4 toward the support W can be suitably established on considering the conditions, such as composition, physical property, supply flow rate, supply liquid pressure, and the like, of the coating composition C. In short, it is preferable that the coating composition C laminarly flows out from the pocket section 3 with a flow rate and a liquid pressure distribution which are uniform in the widthwise direction perpendicular to the direction of movement of the support W.

At the exit 4*b* of the slot section 4, the front blade 5 is vertically separated by a distance t from the back blade 6, the blades 5, 6 being located at the upstream and downstream portions with respect to the direction of movement of the support W, respectively.

4. Front and Back Blades

The front blade 5 is located in the upstream of the exit of the slot section 4 with respect to the direction of movement of the support W and projects toward the support more than the back blade by about 0.01 to 5.0 mm to thereby form the aforementioned distance t.

Further, the front blade 5 has an edge surface facing the support W, which surface is curved in cross section with a radius of curvature (r) of 1 to 50 mm so as to be convex toward the support.

Preferably, the length $l_3$ of the edge surface of the front edge 5 (in the direction of movement of the support W) is selected to be 0.5 to 10 mm.

Further, with respect to the height of the opposite walls of the slot 4 forming the aforementioned distance t, each of the heights ($l_1$) of the front wall 4*c* formed by the front blade 5 and the height ($l_2$) of the back wall 4*d* formed by the back blade 6 may be suitably selected to a value within a range of 20 to 100 mm.

The extruder 1 is formed of wear-resistant hard metal, such as that having a Rockwell hardness of about 90.

According to the apparatus of the present invention, the support W is stretched with substantially constant tension by running guide means such as guide rollers and the like. The support W is slightly curved along the edge surface of the front blade 5 by an extruder supporting mechanism (not shown). When the coating composition C is supplied from the coating composition supply system 2 with a suitable flow rate, the coating composition C is successively passed through the pocket section 3 and the slot section 4 and extruded to the exit 4*b* of the slot section 4 with a flow rate and a pressure distribution which are uniform in the widthwise direction perpendicular to the direction of movement of the support W.

On the other hand, prior to coating the composition C, the support W is coated with a precoat layer B soluble in the coating composition C by a suitable coating method (not shown). The precoat layer B doubly functions to prevent the involvement of the air and to blend with the coating composition C when the coating composition C is applied.

The coating composition C extruded to the exit 4*b* of the slot section 4 does not touch the surface of the support W but slightly over overflows from the edge surface of the back blade 6 disposed opposite to the support W at a distance substantially equal to the aforementioned distance t. As a result, the coating composition C is spread along the surface of the support continuously moving in the direction of the arrow A so as to be fitted to the precoat layer B. The edge surface of the front blade 5 and the surface of the support W are always separated from each other with a constant distance by the precoat layer B.

The thickness of the film formed by the coating composition C is determined by the conditions, such as tension of the support W, the distance between the support W and the extruder 1, the supply quantity (liquid pressure) of the coating composition C, the running speed of the support W, and the like. Particularly, a necessary thickness can be easily and accurately established by changing only a condition of the supply quantity of the coating composition C.

Accordingly, the coating composition C extruded by the extruder 1 can be applied to the support W with a necessary space from the edge surface of the back blade 6. The aforementioned problem of a streak-like irregularity of the coating composition film caused by substances caught by the surface of the conventional doctor can be avoided.

Further, the structure according to of the present invention is different from the conventional structure in which the edge surface of the doctor blade functions to spread the coating composition C on the support. In other words, according to the present invention, discharge pressure of the coating composition C can sensitively respond to the changes in thickness or Young's modulus of the support W, so that film of a very uniform thickness can be obtained.

Further, the slot section 4 is tapered to decrease the width of the slot toward the support W so that the pressure loss of the coating composition C is minimized.

In the conventional case where the exit of the slot is equal in width to the entrance of the slot, the pressure of the coating component C is relatively greatly reduced compared to the initial pressure as the coating composition C moves in the slot toward the exit of the slot. However, in the case where the slot section 4 is tapered toward the exit 4*b* of the slot, the reduction of pressure can be minimized just before the coating composition C flows from the exit of the slot.

Accordingly, the pressure of the coating composition in the coating composition supply system 2, which was required to be relatively large compared to the discharge pressure required when the coating composition C is applied to the support W in the conventional extruder, is not always required to be so large in the present invention. Accordingly it is possible to use a relatively small-scaled metering pump mechanism in the present invention.

The method for supplying the coating composition C to the extruder 1 as shown in FIG. 4 is a kind of single-sided supply method through a short pipe 9. This method has been disclosed in U.S. Pat No. 4,465,707. Preferably, another short pipe may be attached to the shield plate 8 so that the coating composition C supplied into the pocket section 3 from the short pipe 9 can be partly discharged to the outside through the short pipe mounted to the shield plate 8. Such a partial, discharge enable the coating composition C to be prevented from remaining in the pocket section 3 for a long time. Therefore, the discharging means for handling the coating composition C has cohesive and thixotropic properties.

Figure 5:
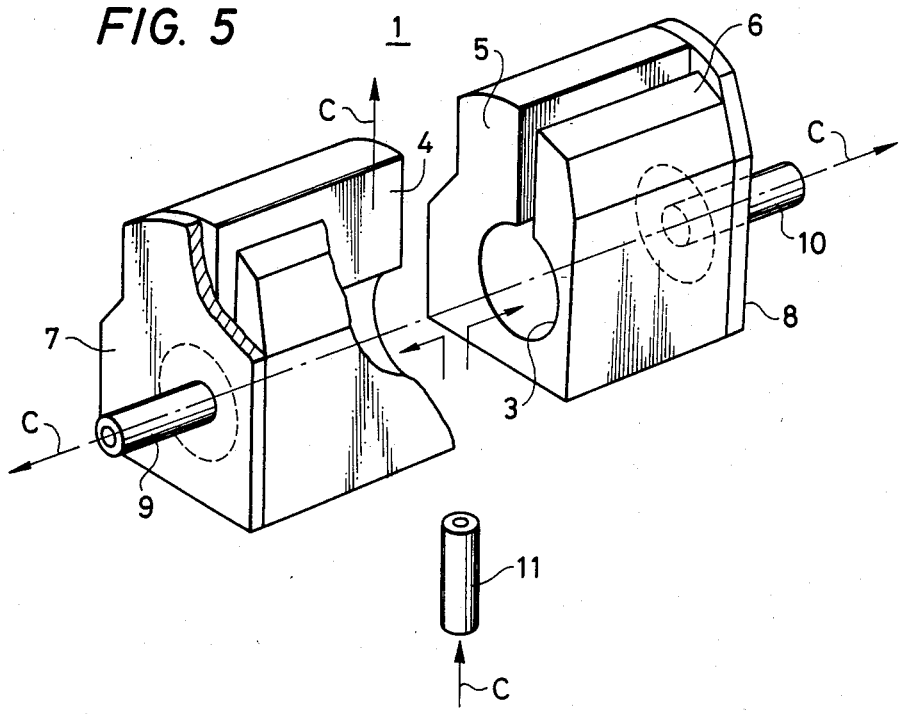
FIG. 5 is a perspective view showing another embodiment in which the method for supplying a coating composition to the extruder depicted in FIG. 3 is modified.

FIG. 5 shows a central supply method in which the coating composition C is supplied from another short pipe 11 provided at the center of the pocket section 3 perpendicular to the plane of the support W.

In the central supply method of FIG. 5, the coating composition C supplied into the pocket section 3 is partly discharged to the outside from both the short pipes 9 and 10 disposed at the opposite ends of the pocket section 3. The other part of the coating composition C does not remain in the pocket section 3 but is discharged from the slot section 4 with uniform liquid pressure.

It is to be understood that the coating composition supply method used in the present invention is not limited to the specific embodiments as shown in FIGS. 4 and 5 and that these embodiments may be used in combination suitably. Further, it is a matter of course that the shape of the pocket section 3 is not limited to the aforementioned circular one and that the pocket section thereof may be suitably square shaped or shaped like a ship's bottom as long as uniform coating composition pressure can be attained in the direction of width.

The apparatus of the present invention as described above has the following novel effects.

(1) Because a suitable space is formed between the support W and the edge surface of the back blade 6 of the extruder 1, foreign substances, such as dust deposited on the support W will never be caught by the edge surface of the back blade 6. Accordingly, the streak-like irregularity on the film surface caused by the foreign substances can be prevented.

(2) Because the coating composition C is applied to the support W by means of the high discharge pressure of the coating composition itself, the coating composition can sensitively respond, through the flexibility of the coating composition itself without any influence on the edge surface of the back brade 6, to the changes in running condition of the support W caused by the change in thickness or Young's modulus of the support W. Accordingly, irregularity in thickness of the coating film can be effectively prevented.

(3) Because the slot section 4 is tapered to decrease the width of the slot toward the exit of the slot from the pocket section 3, the pressure loss of the coating composition C at the slot section 4 can be reduced, thereby attaining a large coating composition discharge speed. Consequently, it is possible to apply a high viscosity coating composition very thinly and speedily, to minimize the coating composition feeding capacity of the coating composition supply system 2 and to make the system 2 relatively small-scaled compared to the conventional system.

In the following examples, the novel effects of the apparatus according to the present invention are clearly described.

EXAMPLE

The constituent materials as shown by weight in Table 1 were fully mixed and dispersed in a ball mill to prepare a magnetic coating composition.

TABLE 1

| |
|---|
| $\gamma$-$Fe_2O_3$ powder (needle-like paricles with a mean length of 0.5 $\mu$m in the long axis and 0.05 $\mu$m in the short axis; coersive force 320 |

TABLE 1-continued

| | |
|---|---|
| oersted; $S_{BET} = 25\ m^2/g$) | 95 part |
| Polyurethane resin | 10 part |
| Epoxy resin | 10 part |
| Polyisocyanate | 8 part |
| Carbon black (mean particle diameter 20 μm) | 2 part |
| Stearic acid | 1 part |
| Cyclohexanone | 300 part |

the symbol Δ shows a quantity of 5.0 to 10.0 cc/m², and the symbol X shows a quantity of 10.0 to 15.0 cc/m². With respect to liquid pressure at the slot section, the symbol O shows a pressure of not more than 3.0 kgf/cm², the symbol Δ shows a pressure of 3.0 to 6.0 kgf/cm², and the symbol X shows a pressure of not less than 6.0 kgf/cm².

TABLE 2

| Sample No. | $d_1$ (mm) | $d_2$ (mm) | $l_1$ (mm) | $l_2$ (mm) | $l_3$ (mm) | $l_4$ (mm) | irregularity | Estimation quantity | Liquid Pressure |
|---|---|---|---|---|---|---|---|---|---|
| 1 | 0.1 | 0.075 | 50.0 | 49.5 | 0.5 | 10.0 | | O | X |
| 2 | 0.2 | " | " | " | " | " | | O | Δ |
| 3 | 0.5 | " | " | " | " | " | | O | |
| 4 | 5.0 | " | " | " | " | " | | O | |
| 5 | 10.0 | " | " | " | " | " | | O | |
| 6 | 2.0 | 0.015 | " | " | " | " | | O | X |
| 7 | " | 0.020 | " | " | " | " | | O | Δ |
| 8 | " | 0.100 | " | " | " | " | | O | |
| 9 | " | 0.300 | " | " | " | " | | Δ | |
| 10 | " | 0.400 | " | " | " | " | | X | |
| 11 | " | 0.075 | 18.0 | 18.0 | " | " | | X | |
| 12 | " | " | 20.5 | 20.0 | " | " | | Δ | |
| 13 | " | " | 35.5 | 35.0 | " | " | | O | |
| 14 | " | " | 75.5 | 75.0 | " | " | | O | |
| 15 | " | " | 100 | 95.5 | " | " | | O | Δ |
| 16 | " | " | 120 | 119.5 | " | " | X | O | X |
| 17 | " | " | 49.5 | 49.5 | " | " | X | O | X |
| 18 | " | " | 49.51 | 49.5 | " | " | Δ | O | |
| 19 | " | " | 49.7 | " | " | " | | O | |
| 20 | " | " | 52.0 | " | " | " | | O | |
| 21 | " | " | 53.0 | " | " | " | | O | |
| 22 | " | " | 54.5 | " | " | " | | Δ | |
| 23 | " | " | 56.0 | " | " | " | | X | |
| 24 | " | " | 50.0 | " | 0.3 | " | | X | |
| 25 | " | " | " | " | 0.5 | " | | Δ | |
| 26 | " | " | " | " | 2.0 | " | | O | |
| 27 | " | " | " | " | 7.0 | " | | O | |
| 28 | " | " | " | " | 10.0 | | Δ | | |
| 29 | " | " | " | " | 12.0 | " | | X | |
| 30 | " | " | " | " | 0.5 | 0.8 | | X | |
| 31 | " | " | " | " | " | 1.0 | | Δ | |
| 32 | " | " | " | " | " | 5.0 | | O | |
| 33 | " | " | " | " | " | 30.0 | | O | |
| 34 | " | " | " | " | " | 50.0 | | Δ | |
| 35 | " | " | " | " | " | 60.0 | | X | |

The equilibrium viscosity of the magnetic coating composition thus prepared was measured by using a SHIMAZU Rheometer RM-1 made by SHIMAZU SEISAKUSHO, LTD. The resultant mixture showed a viscosity of 1.5 poise when the shearing rate was 700 $sec^{-1}$.

A precoat layer was formed by applying 20 μm thick (wet) cyclohexanone by a bar coater.

The support was formed of a polyethylene terephthalate film, had a width of 500 mm, a thickness of 15 μm and was run at a speed of 200 m/min with a tension of 10 kg/500 mm.

The quantity of the applied magnetic coating composition is intended to be 15 cc/m². The extruder as shown in FIG. 3 was used. The streak-like irregularity, the lower-limit quantity of the applied magnetic coating composition and liquid pressure at the slot section were estimated while successively changing the respective values of $d_1$, $d_2$, $l_1$, $l_2$, $l_3$ and r. The results are shown in Table 2. With respect to the streak-like irregularity, the symbol O shows good estimation, the symbol Δ shows that such good estimation cannot always be reproduced and the symbol X shows that the streak-like irregularity occurs frequently. With respect to the lower-limit quantity of the applied magnetic coating composition, the symbol O shows a quantity of not more than 5.0 cc/m², The length of the samples reaches 2000 m long. It is apparent from Table 2 that samples marked solely by the symbol O show excellent lower-limit quantity of the applied magnetic coating composition, liquid pressure at the slot section and little streak-like irregularity and are so excellent that the maximum change in the film thickness is 0.1 μm.

What is claimed:

1. An apparatus for applying a coating composition to an upper surface of a substrate to form a coated layer of a predetermined thickness thereon, said apparatus comprising: an extrusion head, means for mounting a substrate web for movement in a feed direction with respect to said extrusion head, such that said extrusion head is disposed above said web and including a front wall and a rear wall respectively located upstream and downstream with respect to the feed direction, a downwardly tapering coating composition slot defined by and between said front and rear walls, said slot being disposed transverse to said web and having a width which decreases approaching an exit end thereof, coating composition, means for supplying said coating composition to said slot, said front wall having a lower surface convexly curved toward said upper surface of said substrate and disposed in contact therewith, and said rear wall having a lower slot exit edge facing said upper surface and vertically raised above a rear edge of said front wall opposite the edge defining the exit end of said slot by a distance substantially greater than said predetermined thickness such that said exit edge of said rear wall does not limit or determine the thickness of the coated layer formed on the upper surface of the substrate.

2. An apparatus for applying a coating composition according to claim 1, in which a width ($d_1$) of said slot at an entrance of said coating composition is selected to be 0.2 to 5 mm; a width ($d_2$) of said slot at said exit is selected to be 0.02 to 0.3 mm; a length ($l_1$) of said front wall of said slot in the direction of flow of said coating composition through said slot is selected to be 20 to 100 mm; a length ($l_3$) of said lower surface of said front wall with respect to the feed direction is selected to be 0.5 to 10 mm; a length ($l_2$) of said rear wall is selected to be 20 to 100 mm; said distance is selected to be 0.01 to 5 mm; and a radius of curvature (r) at said lower surface of said front wall is selected to be 1 to 50 mm.

3. Apparatus for applying a coating according to claim 1, wherein said back blade is sufficiently spaced relative said means for mounting a substrate web that said back blade will clear a coated layer just formed on a next adjacent surface of said web.

4. The apparatus for applying a coating according to claim 1, wherein said back blade is sufficiently spaced relative said means for mounting a substitute web that said back blade will clear a coated layer just formed on a next adjacent precoated surface of said web.

5. An apparatus for applying a coating composition according to claim 1, further comprising a pocket section communicated with said slot on a side opposite said substrate, and said means for supplying comprises means for continuously supplying said coating compositions to said pocket.

6. An apparatus for applying a coating composition according to claim 5, wherein said pocket section is generally circular with a diameter of 10 to 50 mm.

7. An apparatus for applying a coating composition according to claim 5, wherein said continuous supply means comprises a fluid supply pipe connected to said pocket in a central position thereof relative to said edges of said substrate and further comprising fluid drain pipes connected respectively to side ends of said pocket corresponding to said side edges of said substrate.

* * * * *